US009815606B2

(12) United States Patent
Barton

(10) Patent No.: US 9,815,606 B2
(45) Date of Patent: Nov. 14, 2017

(54) FLEXIBLE STAND-UP POUCH CONTAINER FOR FLOWABLE PRODUCTS

(71) Applicant: Barton Group, Inc., East Hampton, NY (US)

(72) Inventor: Lewis Barton, Wainscott, NY (US)

(73) Assignee: BARTON GROUP, INC., East Hampton, NY (US)

( * ) Notice: Subject to any disclaimer, the term of this patent is extended or adjusted under 35 U.S.C. 154(b) by 0 days.

(21) Appl. No.: 15/143,229

(22) Filed: Apr. 29, 2016

(65) Prior Publication Data

US 2017/0029190 A1 Feb. 2, 2017

Related U.S. Application Data

(60) Provisional application No. 62/154,413, filed on Apr. 29, 2015.

(51) Int. Cl.

| | |
|---|---|
| ***B65D 1/09*** | (2006.01) |
| ***B65D 83/04*** | (2006.01) |
| ***B65D 85/42*** | (2006.01) |
| ***B65D 75/58*** | (2006.01) |
| ***B65D 75/00*** | (2006.01) |
| ***B65D 75/56*** | (2006.01) |
| ***B65D 77/28*** | (2006.01) |

(52) U.S. Cl.

CPC ..... *B65D 75/5866* (2013.01); *B65D 75/008* (2013.01); *B65D 75/566* (2013.01); *B65D 77/286* (2013.01)

(58) Field of Classification Search

CPC ..... B65D 90/00; B65D 83/0055
USPC ..... 222/107, 211, 541.9, 541.6; 220/501, 220/505, 694, 23.4; 215/46–50; 206/528, 530, 532, 538, 539, 534.1, 206/534.2, 820, 216, 229

See application file for complete search history.

(56) References Cited

U.S. PATENT DOCUMENTS

| | | | | |
|---|---|---|---|---|
| 2,705,579 | A | 4/1955 | Mason | |
| 3,207,420 | A | 9/1965 | Navarrete-Kindelan | |
| 3,407,969 | A * | 10/1968 | Klein | B29C 51/165 222/107 |
| 3,640,430 | A | 2/1972 | Roberts | |
| 3,759,375 | A | 9/1973 | Nappi | |
| 3,908,864 | A | 9/1975 | Capper | |
| 3,913,734 | A | 10/1975 | Siegel | |
| 3,940,018 | A | 2/1976 | Scholle | |

(Continued)

FOREIGN PATENT DOCUMENTS

FR 2801283 A1 5/2001

OTHER PUBLICATIONS

Office Action dated Jun. 5, 2015 in Applicant's co-pending application U.S. Appl. No. 15/284,215.

*Primary Examiner* — Vishal Pancholi

(74) *Attorney, Agent, or Firm* — Abelman, Frayne & Schwab

(57) ABSTRACT

A flexible thermoformed stand-up dispensing package for a flowable material is mass produced using dies that provide a container portion, optionally with a dispensing tube, the package having in use a base wall of relatively large area for stably supporting the opened package on a horizontal surface without loss of the flowable contents in either an up-right configuration with a relatively narrower upper region or a low profile package, which optionally includes a dispensing tube.

4 Claims, 8 Drawing Sheets

(56) References Cited

U.S. PATENT DOCUMENTS 4,000,580 A * 1/1977 Biehl ..... A01C 1/02 206/471
4,069,951 A 1/1978 Von Winckelmann
4,209,096 A * 6/1980 Carkhuff ..... B65D 75/366 206/469
4,301,926 A * 11/1981 Chung ..... B65D 77/2052 222/107
4,314,654 A 2/1982 Gaubert
4,322,018 A 3/1982 Rutter
4,322,465 A 3/1982 Webster
4,416,395 A 11/1983 Gaubert
4,491,245 A 1/1985 Jamison
4,491,247 A 1/1985 Nitchman et al.
4,491,250 A 1/1985 Liebermann
4,798,324 A * 1/1989 Gannon ..... B65D 75/58 220/203.16
4,838,429 A 6/1989 Fabisiewicz et al.
4,871,091 A 10/1989 Preziosi
4,935,283 A 6/1990 Jamison
4,949,878 A 8/1990 Jacobi
4,974,732 A 12/1990 Sullivan et al.
4,988,016 A 1/1991 Hawkins et al.
5,104,002 A 4/1992 Cahlander et al.
5,167,973 A 12/1992 Snyder
5,203,459 A 4/1993 Wade
5,272,093 A * 12/1993 Silva ..... B01L 3/505 206/569
5,337,539 A 8/1994 Barton
5,348,191 A 9/1994 Dekeyser
5,356,039 A 10/1994 Christine et al.
5,411,178 A 5/1995 Roders et al.
5,529,224 A * 6/1996 Chan ..... B65D 75/58 222/107
5,632,416 A 5/1997 Lane, Jr. et al.
5,647,511 A 7/1997 Bond
5,735,423 A 4/1998 Black
5,839,609 A * 11/1998 Zakensberg ..... B65D 75/32 206/484
5,931,345 A 8/1999 Lane, Jr. et al.
6,094,886 A 8/2000 Poignant
6,196,420 B1 3/2001 Gutierrez et al.
6,360,916 B1 3/2002 Sokolsky et al.
6,364,519 B1 * 4/2002 Hughes ..... A61B 17/8833 220/221
6,561,383 B1 5/2003 Reddy et al.
6,620,436 B1 9/2003 Rolf
6,624,130 B2 9/2003 Giblin et al.
6,651,848 B1 11/2003 Redmond
6,779,657 B2 8/2004 Mainwaring et al.
6,883,683 B1 4/2005 Cunningham et al.
D512,651 S 12/2005 Stefandl
7,021,495 B2 4/2006 De Laforcade
7,334,702 B2 2/2008 Cunningham et al.
7,690,555 B2 4/2010 Churvis et al.
8,141,709 B2 3/2012 Klaus
8,381,941 B2 2/2013 Barton
8,430,266 B2 4/2013 Barton
9,187,225 B2 11/2015 Barton
2003/0029884 A1 2/2003 Rau
2003/0231808 A1 12/2003 MacHacek et al.
2004/0118859 A1 6/2004 Stefandl
2006/0086640 A1 4/2006 Luciano, Jr. et al.
2007/0164045 A1 * 7/2007 Wydler ..... B65D 75/5866 222/106
2007/0228073 A1 10/2007 Mazzarino
2007/0231431 A1 10/2007 Roche et al.
2009/0301923 A1 * 12/2009 Van Puijenbroek ..... B65D 1/22 206/518
2010/0086239 A1 4/2010 Latour
2010/0270330 A1 * 10/2010 Caldwell ..... B65D 21/0202 222/107
2011/0272421 A1 * 11/2011 Barton ..... B65D 75/366 220/694

* cited by examiner

FLEXIBLE STAND-UP POUCH CONTAINER FOR FLOWABLE PRODUCTS

FIELD OF THE INVENTION

The present invention relates to sealed flexible stand-up pouch containers, and optional integral drinking straw, that will retain a beverage or other flowable product when placed on a horizontal surface after opening and during use.

BACKGROUND OF THE INVENTION

Containers for liquids and other flowable products in the form of light weight and highly flexible stand-up pouches provide the benefits of rigid packages, such as bottles and paperboard cartons, by providing the user with the capability of putting the pouch down between servings, as in beverage use; the marketer benefits from a classic billboard style of principal display panel when the container is shelved for merchandising at the retail level.

Flexible pouches that are mass produced from webs and sheets of flexible polymeric material with various forms of dispensing tubes are known in the art, and include dispensing pouches for flowable fluids described in U.S. Pat. No. 8,381,941 and U.S. Pat. No. 8,430,266, the disclosures of which are incorporated in their entirety by reference. Several embodiments of a beverage dispensing pouch that is thermoformed using sheets or webs of flexible polymeric material and having an integral straw for withdrawing the liquid contents by the user are disclosed in U.S. Pat. No. 9,187,225, the disclosure of which is incorporated herein in its entirety by reference.

Conventional stand-up pouches are generally made by forming a gusset in the bottom in order to provide a flat bottom surface, or base, for the upper portion of the pouch. The gussets formed on lightweight flexible stand-up pouch containers of the prior art are conventionally formed in one of two ways:

1. folding and sealing the edges of the flexible packaging material to integrally form the gusset from the same web or sheet of packaging material without cutting to produce a gusseted bottom with the front and rear panels extending upwardly to form the stand-up pouch;
2. adding a separate piece of folded material to the two sheets that become the front and rear panels that are then sealed along the periphery to form the gusset. Using the added separate piece allows the package to be constructed with a heavier gauge and somewhat more rigid, but still flexible material for the gusset producing the benefit of (a) a better package and/or (b) a more economical package because the thicker added piece allows thinner, less expensive material to be used for the much larger front and back panels.

In one embodiment of the '225 patent, the dispensing package with an integral straw is formed with a gusset in the base opposite the side from which the dispensing tube, or straw extends that allows the package to be positioned in an upright position on a horizontal surface. Shown in FIG. 1 is typical gusseted package 100 of the prior art which includes a container portion 110 formed by opposing sidewalls 112, base wall 114, top wall 116 that includes a dispensing tube 140 having a dispensing channel 142 closed by end seal 146 that is removable along tear line 144. The top cover sheet is heat sealed around the periphery 120 after the package is filled following thermoforming of the bottom sheet. A gusseted front panel 130 is illustrated with the gusset partially opened at 132.

Although the gusseted package configuration satisfies the desire to maintain the package in an upright position so that once the end of the dispensing straw has been removed for use, there is little risk that the liquid contents will be inadvertently passed from the end of the straw, it would be desirable to provide a package configuration and a method of its manufacture that could achieve the same or a comparable advantage without the need of forming a gusset.

Thus, the problem addressed by the present invention is how to simplify the manufacturing steps and the configuration of the finished highly flexible stand-up beverage dispensing package produced from relatively light weight thin gauge polymer films that can be thermoformed and heat sealed reliably for mass production of the product. Additionally, the desired package configuration, optionally configured with an integral straw, should minimize the risk that the liquid or flowable contents will escape from the open end of the package, or optional straw, when the package is placed on a horizontal surface during use.

SUMMARY OF THE INVENTION

The above problems are solved and other benefits are realized in the practice of the present invention which is directed to novel configurations and methods of producing highly flexible stand-up pouch containers for liquids and other flowable materials that are dimensioned and configured to stably position the center of gravity of the contents of the package over the base of the package in order to maintain the desired orientation with the open portion of the package, or the end of the straw, if present, at a position above the level of the liquid in the pouch. In the two methods described below, one embodiment will be referred to as the "up-right" stand-up pouch configuration, and the second embodiment will be referred to as the "low profile" stand-up pouch configuration.

Up-Right Containers

In one embodiment of the invention, the wider end of the trapezoidal or triangular wall terminates at the base wall. This configuration of the die results in the formation of a container portion having a relatively wide base as defined by the wider end of the opposing sidewalls.

In an embodiment of the invention, a flexible thermoformed stand-up dispensing package for a flowable material is package produced from one or more heat-sealable polymeric sheets as follows:

a. a bottom sheet is thermoformed into a container portion that includes a recessed chamber having a bottom surface and integrally formed opposing side walls, a top wall and a base wall and is bounded by a peripheral area, the chamber being configured and arranged to receive the flowable material, and
b. a top cover sheet is superposed on, and heat-sealed to the periphery of the bottom sheet, and the opposing sidewalls are either generally trapezoidal or triangular and the narrow end of the trapezoid or the apex of the triangle defines the top wall of the recessed chamber; the opposite end of each of the sidewalls defines the base wall, and the base wall is dimensioned and configured to maintain the center of gravity of the flowable material in the package over the base wall when the base wall of the filled package is in contact with a horizontal surface. In the case of opposing trapezoidal sidewalls the width of the top wall can be predetermined by one of ordinary skill in the art to accommodate the desired volumetric content of the package, and the ratio of the package height to the area of the base wall to provide stability to the open package on a horizontal surface.

In the embodiment where the opposing sidewalls are triangular, the top wall as generally defined above is a line corresponding to the interior edge of the adjacent hot-sealed peripheral area where the bottom surface and the top cover sheet are joined together. Either of these embodiments can also include a dispensing tube integrally formed with, and projecting from the top wall of the container portion and bounded by a contiguous peripheral seal that defines a dispensing channel configured and dimensioned for passing the flowable material from the chamber. The dispensing tube is integrally formed from the bottom sheet and heat-sealed to the top cover sheet. In a preferred embodiment, the base of the dispensing tube channel is in fluid communication with the chamber, via an internal extension defined by one or more integral thermoformed walls extending from the bottom surface of the recessed chamber and terminating proximate the base when the package is in up-right position to facilitate sipping of a beverage from the container portion.

Low Profile Containers

In another embodiment in which the flexible thermoformed dispensing package includes a dispensing tube that is integrally formed with, and projects from the container portion, the sidewalls of the die and the corresponding package are trapezoidal with the wide ends defining the width of the top wall of the recessed chamber. The base wall in this embodiment is narrower than the opposing top wall. In this embodiment, the bottom surface of the recessed chamber is of a relatively larger area than either the top wall or base wall and serves as the contact surface when the dispensing package is in use with the end of the dispensing tube removed for withdrawing the liquid contents from the package.

As will be understood by one of ordinary skill in the art, when the liquid contents, e.g., a beverage or medication is added to the recessed chamber prior to the placement of the top sheet and its sealing to the periphery of the bottom sheet, a predetermined volume of free air space will be provided by under-filling the recessed chamber. When the sealed package is placed on a horizontal surface, the free space containing only air will cause the upper portion with the dispensing straw to be raised above the surface of the liquid inside of the sealed container. Thus, when the user has opened the sealed end of the dispensing tube, e.g., to sip liquid from the package, and replaces the package on a horizontal surface, the liquid will not be discharged from the recessed chamber because the surface of the liquid is below the open end of the dispensing tube. As will be understood by one of ordinary skill in the art, the length and materials of construction of the dispensing tube effect the extent to which the dispensing tube retains sufficient rigidity to avoid bending or flexing under its own weight to lower the open end of the tube below the surface of the liquid in the container portion. The gauge of either the top or bottom polymer sheets, or both, can be increased to provide the required degree of rigidity to maintain the dispensing tube in an extended orientation.

The practice of both methods and the packages thereby produced advantageously utilize the manufacturing system or apparatus known as Horizontal Thermo-form/Fill/Seal (HTFFS) package production. This method of production can be utilized with commercial packaging machines made by a number of firms including Multivac Inc. at 11021 N Pomona Avenue, Kansas City, Mo.; Harpak-UILMA Packaging, LLC at 175 John Quincy Adams Road, Taunton, Mass. 02780; Reiser at 725 Dedham Street, Canton, Mass.; and others. The flexible polymeric packaging materials or films used for the front and back of the packages have different properties. In the HTFFS process, the films or webs are referred to as the top and bottom sheets. The bottom film is drawn horizontally from a mill roll across the die, or the forming tool which is secured to the bed of the apparatus. When in position across the die, the film is heated after which it becomes pliable and because of its forming properties, is drawn into the die by a vacuum. This forming process is sometimes assisted by a heated male plug that serves to press the pliable bottom film into the die to assure that the desired contour is achieved. As it is drawn into the die, the polymeric material conforms to the shape of the die in all dimensions, creating a matching recessed chamber. In accordance with prior art designs, the shape of the package so formed is generally rectangular with the depth of the draw into the die producing walls of the container portion of the same depth around all four sides of the recessed chamber. A representative configuration of the container portion of the prior art was described above with reference to FIG. 1.

As the film is drawn into the pocket, it thins out as the drawing step distorts the film from its original planar configuration and in so doing spreads the same amount of film over a greater surface area in order to cover the side walls and the bottom of the die. This stretching of the film to cover a greater area results in some thinning, especially in the regions of the corners and the bottom. This aspect of thermo-forming using the HTFFS process and apparatus is well known in the art.

In accordance with the present invention, the die in which the thermoformed container portion of the package is formed is not symmetrical in shape so that the film is drawn to form a portion of the packaging having a corresponding shape. As will be explained in more detail below, the opposing sidewalls of the die are generally trapezoidal or they are triangular.

As will be understood by one of ordinary skill in the art, the thermoformed packages of the invention directly correspond to a die which is placed upon the bed of the HTFFS machine. The corresponding elements of the die are referred to herein by the same designations as used to describe the elements of the package that are formed by the die. When the bottom sheet is passed over the die for thermoforming, a vacuum draws the bottom sheet into essentially simultaneous contact with the surface of the top wall, opposing sidewalls and base wall and eventually onto the bottom surface of the die which forms the recessed chamber. The recessed chamber is bounded by a peripheral margin which is contacted by the remaining portion of the bottom sheet at its edges. After filling, the top sheet, or lidding, is brought into contact and heat sealed to the periphery of the bottom sheet where it is supported by the peripheral portion of the die. From this description, it will be understood that each of the elements used to describe the container portion of the thermoformed package corresponds in the elements of the metal thermoforming die. To the extent that the finished thermoformed package is novel, so is the die which is dimensioned and configured to produce the container portion.

It will also be understood that the terminology applied to the elements of the completed package, and as they correspond to the same elements of the thermoforming die, the bottom surface of the recessed chamber (as it is oriented in the die), and the top sheet can respectively become the front and back walls of the finished package in the embodiment described in more detail below in conjunction with the attached drawings.

In the so-called low profile embodiment described in more detail below, the bottom surface and the opposite top cover sheet maintain the same orientation in the finished package as they do in the thermoforming die used to produce that package configuration. In that context, what is the base wall of the die and formed package when filled constitutes the relatively narrow edge of the finished package, which is relatively flat compared to the so-called up right embodiments described above.

As should be apparent from the above description, the improvements broadly comprehend the manufacture via thermoforming techniques and apparatus of highly flexible stand-up pouch containers which have a relatively wide base and walls that are inclined inwardly to a relatively narrower top wall, or where the front and rear walls meet in a heat-sealed peripheral margin that defines a line that is parallel to the base. The invention takes advantage of the flexibility of the material used to form the package and the effect of gravity on the mass of the liquid or other flowable material contained in the sealed package to modify the configuration and generally lower the center of gravity when the package is supported on a horizontal surface. The configuration of the package in accordance with the present disclosure allows the package to be opened and, as a result of its flexibility and changing configuration, to retain the contents in its confines when the intended supporting wall, as defined with respect to the orientation of the package, is in contact with a horizontal surface.

BRIEF DESCRIPTION OF THE DRAWINGS

The invention will be described in further detail below and with reference to the attached drawings in which.

DETAILED DESCRIPTION OF PREFERRED EMBODIMENTS

Figure 1:
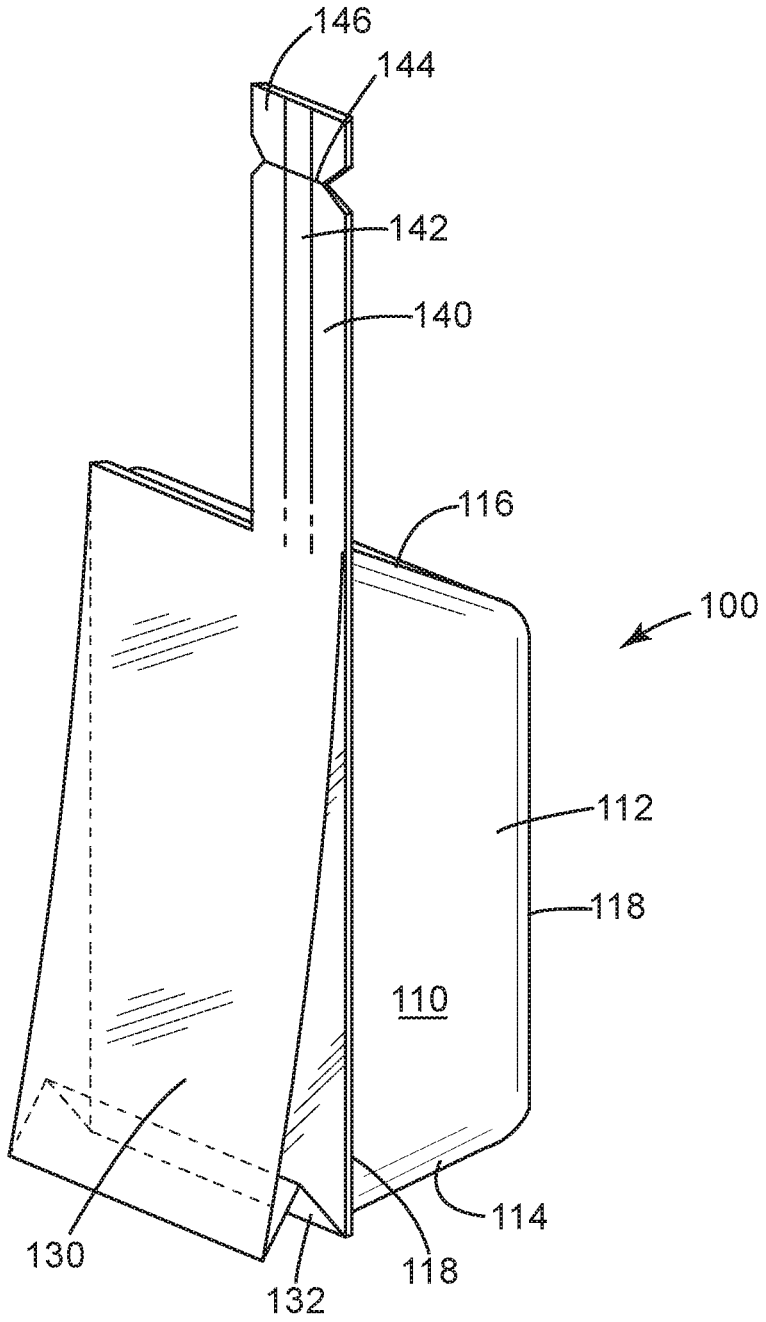
FIG. 1 Prior Art
FIG. 1 is a perspective view of a flexible thermoformed stand-up package of the prior art with a bottom gusset.
Figure 2A:
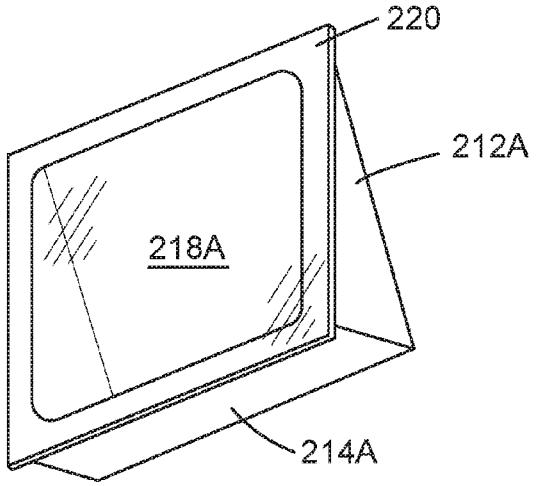
FIG. 2A is a perspective view of a flexible thermoformed stand-up package oriented vertically having a wide base wall in accordance with the present invention as formed and supported in the thermoforming die.

Referring first to FIG. 2A, there is schematically illustrated a thermoformed package in accordance with the invention in which the opposing sidewalls 212A are triangular and the base wall 214A intersects the top cover sheet at right angles.

Figure 2B:
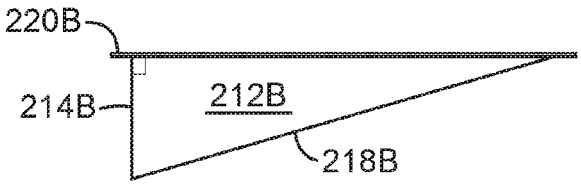
FIG. 2B is a simplified schematic cross-sectional side elevation of a thermoforming die configured and dimensioned to produce the embodiment of the flexible package of FIG. 2A in which the top wall is defined by a thermosealed line, and the base wall forms a right angle with the top cover sheet.
Figure 2C:
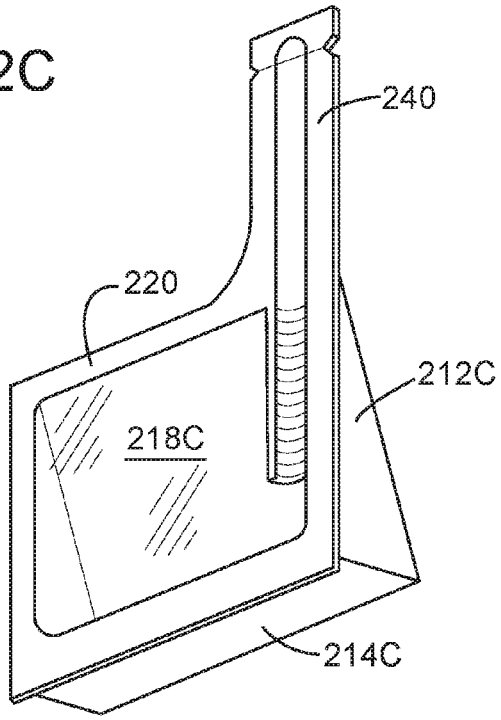
FIG. 2C is a perspective view of a flexible thermoformed dispensing package that is configured and dimensioned similarly to the package of FIG. 2A that includes an integrally formed dispensing tube having an internal extension.

A cross-sectional elevation view of the mold in FIG. 2B used to thermoform the package of FIG. 2A illustrates this relationship. The bottom surface of the die 218A as shown is planar and the apex of the triangular sidewalls results in a top wall that is defined by the heat sealing of the top cover sheets and the bottom sheet along line 216. A similar arrangement is illustrated in FIG. 2C, where the package 200C includes a dispensing tube 240, but is otherwise of the same configuration.

Figure 3A:
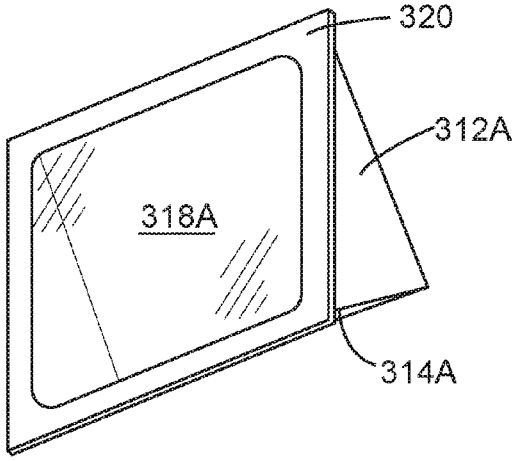
FIG. 3A is a perspective view of a flexible thermoformed stand-up package oriented vertically having a wide base wall in accordance with the present invention as formed and supported in the thermoforming die.
Figure 3B:
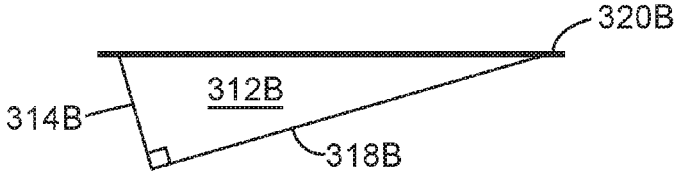
FIG. 3B is a simplified schematic cross-sectional side elevation of a thermoforming die configured and dimensioned to produce the embodiment of the flexible package of FIG. 3A in which the top wall is defined by a thermosealed line, and the base wall forms a right angle with the bottom surface of the die.
Figure 3C:
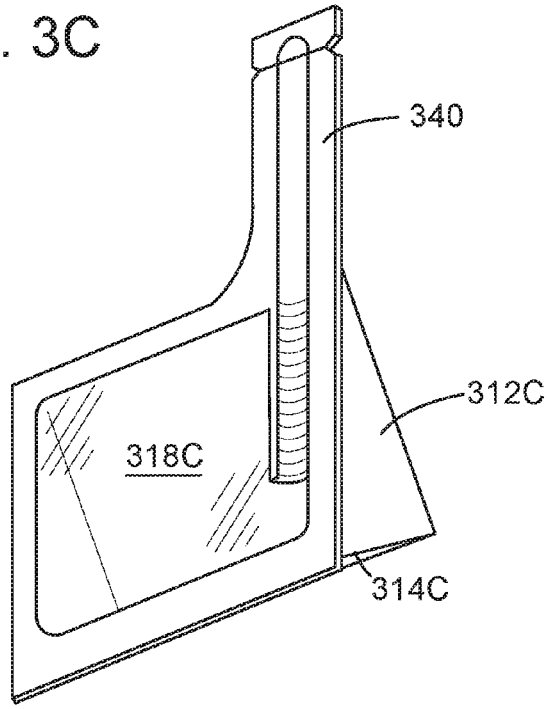
FIG. 3C is a perspective view of a flexible thermoformed dispensing package that is configured and dimensioned similarly to the package of FIG. 3A that includes an integrally formed dispensing tube having an internal extension.

Referring to FIG. 3A, an embodiment is illustrated where the bottom surface 318A and the base wall 314A form a right triangle which is best shown in the side elevation of the die in FIG. 3B. FIG. 3C illustrates a similar configuration of the planar bottom surface and base wall where the package is provided with a dispensing tube 340 that extends into the recessed chamber containing the typically liquid beverage.

Figure 4:
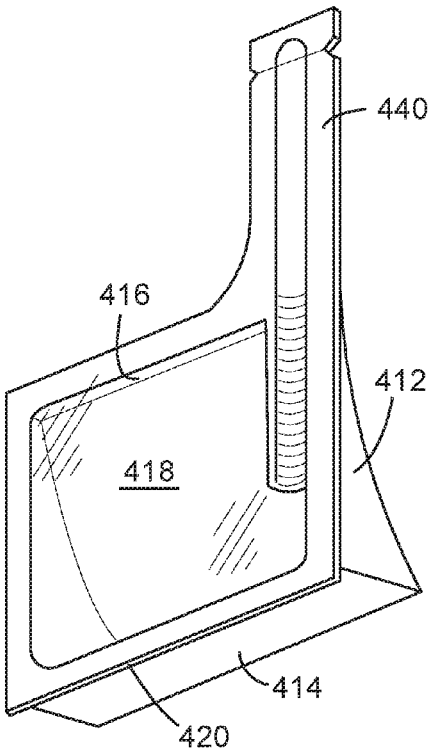
FIG. 4 is a perspective view of a flexible thermoformed dispensing package oriented vertically that has a planar top wall and that includes an integrally formed dispensing tube having an internal extension, where the bottom surface is formed with a concave configuration.
Figure 5:
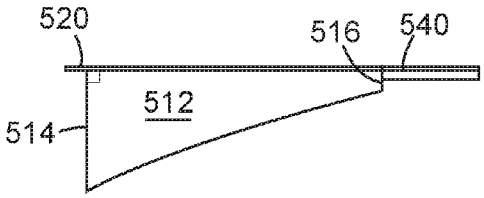
FIG. 5 is a simplified schematic cross-sectional side elevation of a thermoforming die configured and dimensioned to produce the embodiment of the flexible package of FIG. 4 having a planar top wall, where the base wall forms a right angle with the top cover sheet and the bottom surface is formed with a convex configuration.

FIG. 4 illustrates another embodiment of an up-right package in which the recessed chamber is formed with a top wall 416 and the bottom surface 518 of the die 500, as illustrated in FIG. 5 is convex, thereby producing a corresponding concave configuration of the surface 418 of the thermoformed package 400. In this configuration, the base wall 414 forms a right angle with the top cover sheet and the concave wall 418 forms a vertical wall when the package is in use. Note that the die 500 has opposing sidewalls 512 that are generally trapezoidal as defined by parallel base wall 514 and top wall 516, although the bottom surface 518 is curved.

The orientation of the die in FIG. 4 represents the production stage where the horizontal top line corresponds to the bed of the HTFFS machine. The package as illustrate in FIG. 4 is configured with one end of side wall 412 much deeper resulting in a deeper draw than the opposite end from which the dispensing tube projects. When filled, the package will assume the self-supporting stand-up orientation on the base. As will be described below, maintaining the position or orientation shown in FIG. 4 is assisted by the material filling the package, whether it is a liquid or a dry flowable material. A flowable solid product will also move under the force of gravity to settle into the wider lower region to expand the packaging material, so that the center of gravity is shifted to the larger portion creating a weighted bottom region which permits the otherwise flexible pouch to stand in a generally vertical position on a horizontal surface between uses.

Figure 6A:
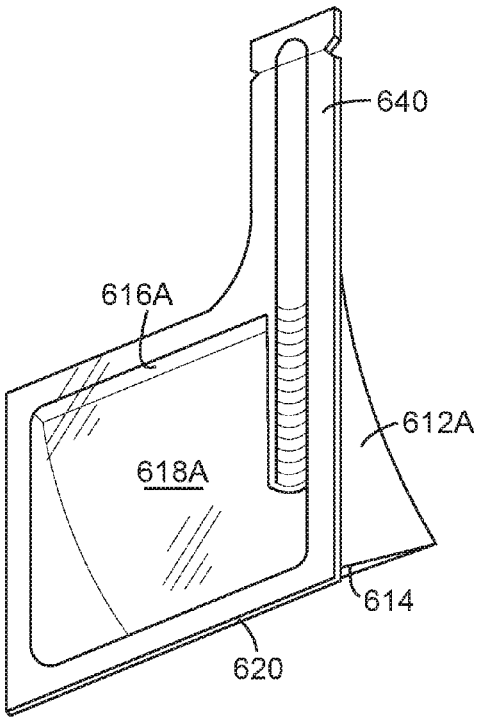
FIG. 6A is a perspective view of a flexible thermoformed dispensing package that is configured and dimensioned similarly to the package of FIG. 4 that includes an integrally formed dispensing tube having an internal extension, where the bottom surface is formed with a concave configuration.
Figure 6B:
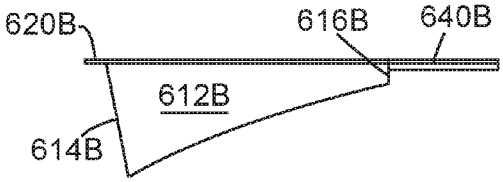
FIG. 6B is a simplified cross-sectional side elevation of a thermoforming die similar to that of FIG. 5 in which the bottom surface of the die is convexly curved from its intersection with the base wall to form the package of FIG. 6A.

Referring now to FIG. 6A, a similar configuration to FIG. 4 is illustrated where the top wall 616A of the package formed by the corresponding top wall 616B of the die as shown in FIG. 6B. Here also the bottom surface 618A of the thermoformed package assumes a concave configuration as formed by the convex surface 618B of the die as shown in FIG. 6B and the package top wall 616A correspondingly formed by the top wall of the die 616B.

Figure 7A:
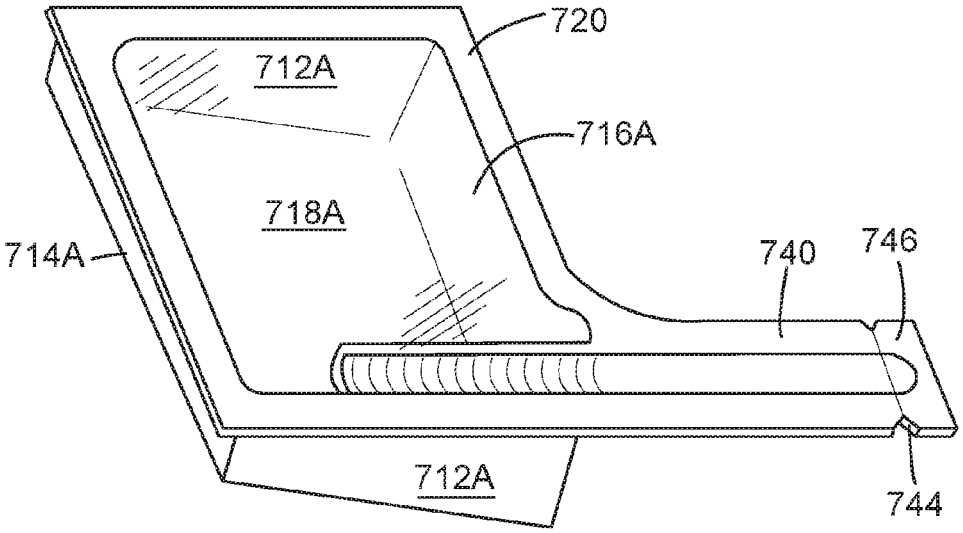
FIG. 7A is a top and side perspective view of a thermoformed package with a dispensing tube and having a low profile defined by the narrow ends of the trapezoidal side walls that define the base wall.

The low profile flexible dispensing package will be described with reference to FIGS. 7A and 7C. Referring first to FIG. 7A, the package 700 includes a dispensing tube 740 having end seal 746 and tear line 744. In this embodiment, the trapezoidal sidewalls 712A are configured to provide a relatively narrower base wall 714A and a wider or deeper top wall 716A.

Figure 7B:
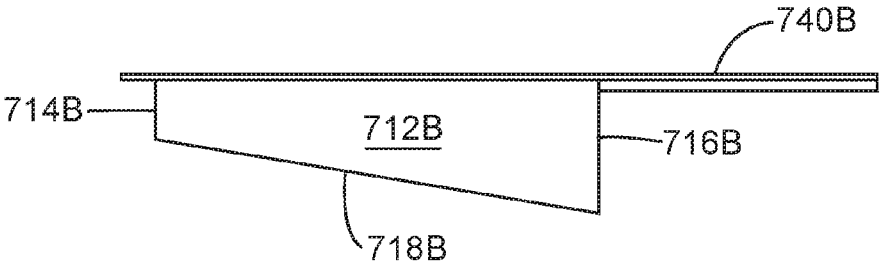
FIG. 7B is a simplified schematic cross-section side elevation of a thermoforming die configured and dimensioned to form the embodiment of FIG. 7A with a dispensing tube and trapezoidal side walls, where the planar bottom surface of the die forms the support for the package in use.
Figure 7C:
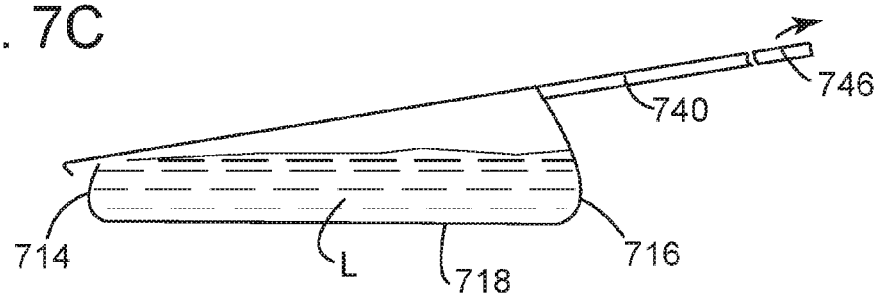
FIG. 7C is a right side elevation of the package of FIG. 7A illustrating the deformation of the walls to lower the center of gravity of the package when it is filled with a flowable product.

The configuration of the die is illustrated in FIG. 7B where the dimensions of the relatively shallow base wall 714B as configured to the top wall 716B are clear. In this embodiment, the bottom surface 718A of the package as formed by the planar bottom surface of the die 718B serves as the supporting surface when the package is placed on a horizontal surface as shown in FIG. 7C. It is noted that the top wall and base wall expand outwardly due to the internal pressure of the liquid L inside of the container. This expansion of the top wall 716C has the desirable effect of lifting the dispensing tube 740 which is opened by removal of the end seal 746 above the surface of the liquid L which is parallel to the horizontal surface supporting the opened package 700. Since the package is highly flexible, the user can easily grasp the portion of the package above the free or air space to sip the liquid from the open end of the dispensing tube 740.

Both the up-right and low profile embodiments produce a flexible stand-up pouch container, thereby allowing the user to open and dispense or consume a portion of the product, place the flexible pouch down on a horizontal surface without loss of the product from the open container, and then, at a later time, dispense or consume the balance of the product.

It will be understood that the product labeling will take into account the orientation of the surface that will be displayed when the package is placed on a horizontal surface at the point of retail sale, or on a table by a consumer during use. In the embodiment where the height of the package is relatively small, a trademark or other identifier can be prominently displayed on the edge as viewed by the consumer when the package is shelved.

The flexible stand-up pouch containers of the present invention provide the capability of forming single-use and securely resealable liquid containers that take advantage of the inherent flexibility of the packaging material that enables it to deform and effectively lower its center of gravity over the supporting wall predetermined when the opened package is in contact with a horizontal supporting surface.

In an embodiment, the upper portion of the package is provided with a zipper and slide recloseable opening at the time of manufacture. Suitable polymer zipper devices are commercially available, e.g., from Zip-Pak in Manteno, Ill. This type of closure can be incorporated on the top cover sheet. The cover sheet is slit or otherwise provided with a narrow opening and the closure heat-sealed to the sheet so that it is in the sealed position when the bottom sheet and top cover sheet are heat sealed after filling. Alternatively, the zipper and slide closure can be purchased from the manufacturer on a continuous web that serves as the top sheet. Another advantage of this configuration is the ability to reuse, i.e., refill, the package once the original contents have been dispensed.

In an embodiment of the invention, the top portion or a corner opposite the supporting base or bottom surface can be provided with a laser or heat-scored tear line for the manual removal of a portion of the sealed package and its periphery in order to dispense the contents. Placement of the line of separation of the portion of the package to be removed will necessarily take into account the volume of the contents and the amount of free air space when the package is positioned on a horizontal surface. This determination is well within the skill of the art.

In an embodiment, the package can be formed at the time of manufacture with an extension of the periphery that is provided with one or more openings to receive retail display supports, e.g., for stocking the product or for point of purchase display.

Figure 8:
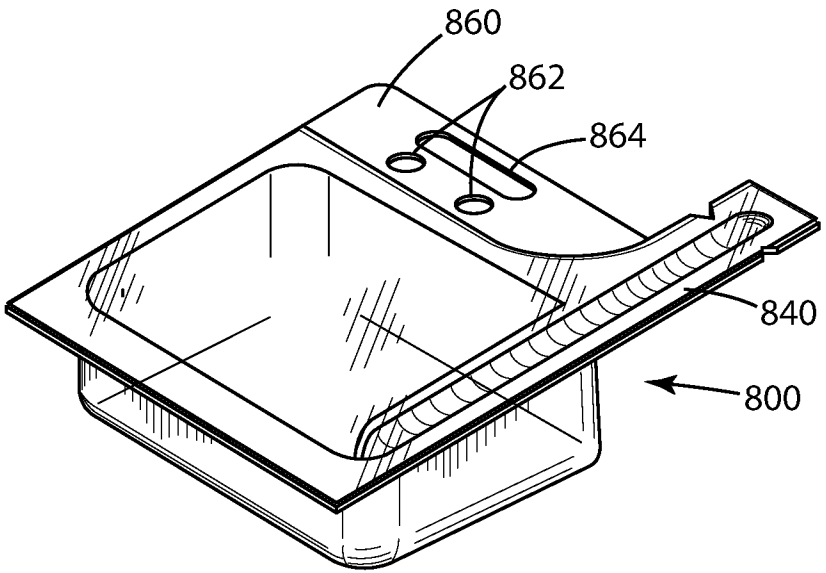
FIG. 8 is a perspective view of an embodiment of the flexible thermoformed package of the invention that is configured for vertical suspension on a retail display rack.

Reference is now made to FIG. 8 which illustrates a filled heat sealed flexible stand-up pouch container 800 that is provided with a dispensing tube 840. This embodiment of the invention is also configured for placement on a retail sale display rack. In this configuration, the improved dispensing package is produced with a wide peripheral seal 860 at the top adjacent the dispensing tube 840. One or more openings 862, 864 are provided in a sealed area that are configured and dimensioned to receive a conventional horizontal support of the type used by retail establishments to display packaged snacks and the like. The openings can be die cut, punched or produced by heat deformation. Reinforced openings 862, 864 permit display of the package for sale without taking up valuable shelf space and allows placement at the chock out station, e.g. at convenience stores, to encourage impulse purchases.

Figure 9:
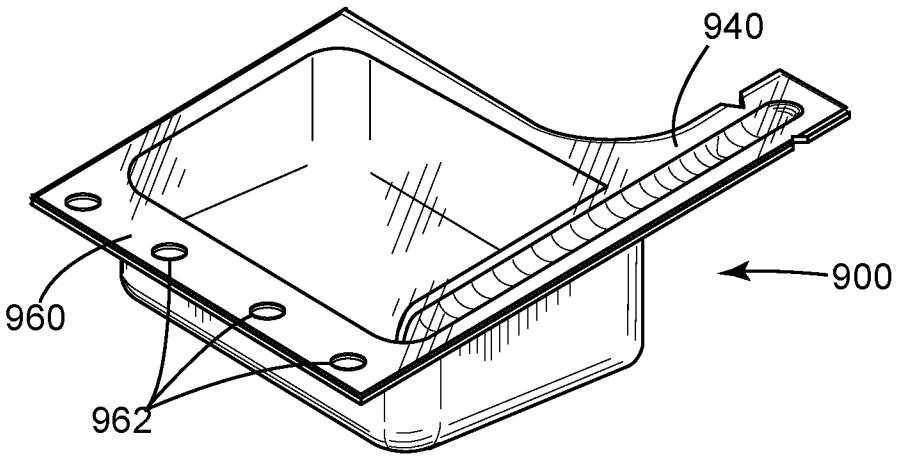
FIG. 9 is a perspective view similar to FIG. 12 schematically illustrating another configuration of the package adapted for vertical suspension on retail display rack supports.

Referring now to the embodiment illustrated in FIG. 9, the sealed package 900 includes an extended heat sealed peripheral portion 960 opposite the dispensing tube 940. The extended peripheral portion 960 is provided with at least one, but preferably at least two, or as illustrated here, four openings 962 to permit the finished package to be positioned on a display rack at the point of sale or other retail location. Due to the flexibility of the polymer films forming the bottom and top sheets which are heat sealed at this location, the projecting suspension portion 960 will not interfere with the stability of the package when it is placed on the base surface. It will also be understood that the projecting portion can extend from the opposite top wall 916 adjacent the dispensing tube 940 of the package.

Figure 11:
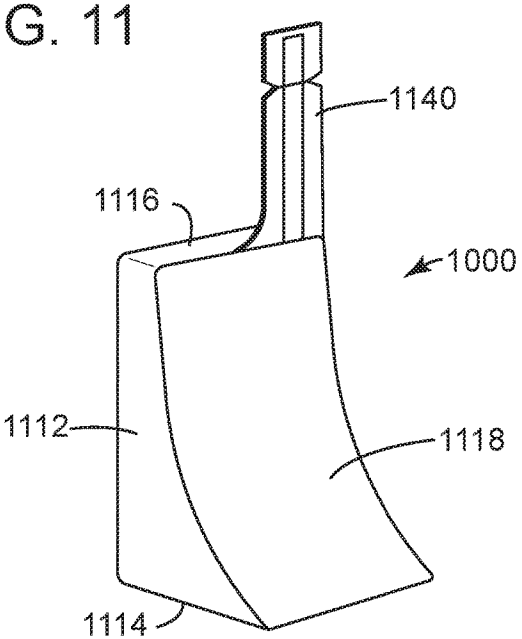
FIG. 11 is the same perspective view of the package of FIG. 10 as formed in the die shown in the vertically oriented stand-up position on a horizontal surface.
Figure 10:
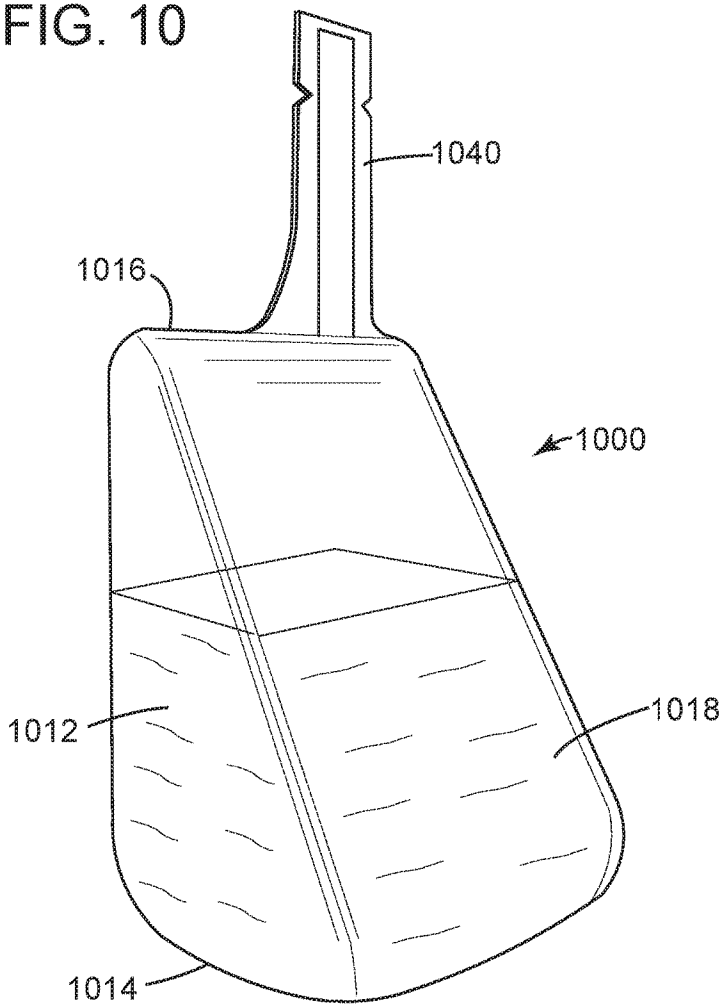
FIG. 10 is a left side front perspective view of a flexible thermoformed package of FIG. 11 that has been filled with flowable contents illustrating the deformation and lowered center of gravity.

Referring to FIGS. 10 and 11, the former illustrates the thermoformed package shown in the up-right position as contained in the thermoforming die that has been filled partially with a flowable material, thereby causing the expansion of the sidewalls and the front panel which corresponds to the bottom surface of the die as previously described. As will be appreciated from the illustration of FIG. 10, the ability of the highly flexible packaging material to be easily deformed, but without rupturing or tearing of the heat-sealed peripheral seams, enables the package to present a lower center of gravity and thereby stabilize the open package. This effect is achieved whether the package is provided with the dispensing tube as shown in FIGS. 10 and 11, or if the dispensing tube is omitted and the upper portion of the package is fitted with a zipper and slide closure or with a weakened cornea-tear line.

It is to be understood that the relative dimensions depicted in the schematic illustrations of the several embodiments disclosed are not meant to be limiting and that the figures are not intended to be drawn to any particular scale. Rather the specific configurations and orientations of the packaging are meant to be illustrative and informative of the scope of the invention as will readily be understood by one of ordinary skill in the art. It will also be understood that the inclusion of dispensing tubes in any one or the other of the various embodiments depicted is optional and that the package will have utility when provided with other dispensing means, including weakened tear lines and recloseable polymeric zipper closures known to the art.

The dimensions for the width and depth of the base wall when used in the upright configuration are not critical and, as will be apparent to one of ordinary skill in the art, can readily be determined based upon the volumetric fill or contents of the weight to be placed in the dispensing package in order to achieve stability when the open package is on a horizontal supporting surface. Suitable dimensions for a flexible thermoformed package with a dispensing tube and internal extension containing 8 fl. oz. of a beverage, are as follows, all measurements being in millimeters (mm): base wall 65×65; top opening 15×65; length of dispensing tube 70 width of dispensing channel 15; overall width to periphery of dispensing tube including seal 28; narrow end of trapezoidal side wall at top wall 11; and angle of bottom surface to top cover sheet 28°. Dimensions (in mm) for a package without a dispensing tube internal extension for a 42 fl. oz. fill are a width of 105 and a length of 150.

While various exemplary embodiments of the invention have been described above, and in the attached drawings, further modifications will be apparent to those of ordinary skill in the art from these examples and these descriptions. The scope of the invention is to be determined with reference to the claims that follow.

The invention claimed is:

1. A highly flexible thermoformed stand-up dispensing package for a flowable material, the package produced in a shape-defining die from one or more heat-sealable polymeric sheets and comprising:

a. a highly flexible bottom sheet thermoformed into a container portion that includes a recessed chamber having a bottom surface and integrally formed opposing side walls, a top wall and a base wall and bounded by a peripheral area, the chamber configured and arranged to receive the flowable material, and b. a highly flexible top cover sheet superposed on, and heat-sealed to the periphery of the bottom sheet, wherein the opposing sidewalls are generally trapezoidal or triangular and the narrow end of the trapezoid or the apex of the triangle defines the top wall of the recessed chamber, and the opposite end of each of the sidewalls defines the base wall, the base wall being dimensioned to maintain the center of gravity of the flowable material in the package over the base wall, and where the inherent flexibility of each of the one or more polymeric sheets comprising the dispensing package results in the deformation of the surfaces of the bottom sheet and top cover sheet in response to the movement of the flowable material when the filled package is removed from the die, which flexibility of the dispensing package results in its deformation to lower its resulting center of gravity when the base wall of the filled package is in contact with a horizontal surface.

2. The package of claim 1, where the sidewalls are triangular and the top wall is a line defined by the interior edge of the adjacent sealed peripheral area.

3. The package of claim 1 further comprising a dispensing tube integrally formed with, and projecting from the top wall of the container portion and bounded by a contiguous peripheral seal, the dispensing tube defining a dispensing channel configured and dimensioned for passing the flowable material from the chamber, the base of the dispensing tube channel being in fluid communication with the chamber, the integral dispensing tube being formed from the bottom sheet and heat-sealed to the top cover sheet.

4. The package of claim 3, where the sidewalls are triangular and the top wall is a line defined by the interior edge of the adjacent sealed peripheral area that intersects the dispensing tube.

* * * * *